United States Patent [19]

Wilson

[11] 4,208,049

[45] Jun. 17, 1980

[54] CONSTANT FORCE SPRING POWERED EXERCISING APPARATUS

[76] Inventor: Robert J. Wilson, 8401 E. Cambridge, Scottsdale, Ariz. 85257

[21] Appl. No.: 935,469

[22] Filed: Aug. 21, 1978

[51] Int. Cl.[2] ..... A63B 21/02

[52] U.S. Cl. ..... 272/138; 272/140; 272/141; 272/143; 308/189 R

[58] Field of Search ..... 272/136, 138, 142, 143, 272/144, 132, 118, 140; 73/379; 128/25 R; 308/189 R, 230, 233, 191

[56] References Cited

U.S. PATENT DOCUMENTS

| | | | |
|---|---|---|---|
| 254,108 | 2/1882 | Bryon | 272/136 |
| 3,876,265 | 4/1975 | McCloskey | 308/189 R X |
| 4,149,715 | 4/1979 | Kasmer | 272/136 X |

FOREIGN PATENT DOCUMENTS

| | | | |
|---|---|---|---|
| 815411 | 6/1969 | Canada | 272/140 |
| 349810 | 12/1937 | Italy | 272/132 |

*Primary Examiner*—William R. Browne
*Attorney, Agent, or Firm*—Warren F. B. Lindsley

[57] ABSTRACT

A multi-functional exercising device comprising spring device employing a plurality of constant load springs. Said springs are chosen individually or in groups to provide a selected constant load force on a foot or hand grip movable bar or mechanism.

7 Claims, 11 Drawing Figures

CONSTANT FORCE SPRING POWERED EXERCISING APPARATUS

BACKGROUND OF THE INVENTION

It has long been the practice with those directly interested in undertaking a physical fitness or body building program to utilize the standard weight lifting devices, such as the common barbell or dumbbell training sets, for the purpose of systematically performing various isotonic exercises which provide for a toning of selective muscles throughout the body. That such exercises are desirable for individuals of all backgrounds and status is readily apparent from the current interest and enthusiasm that has been generated by both the medical profession and physical fitness advocates who urgently recommend that every member of the general public discipline themselves to a form of systematic and individually oriented physical fitness program.

In performing body firming exercises, it is necessary, to achieve maxium effect, that the selective skeletal muscle or muscles toward which the physical exertion is directed not only be tightened and hardened during the exercise, but should likewise concurrently be alternately contracted and expanded to achieve maximum toning and development. Muscle construction is basically a formation of tissue which is fibrous in content, and to simply tighten this fibrous tissue in performance of an exercise without stretching or contracting the muscle fails to provide its full development. For this reasons, the so-called isometric exercises which are designed to acquire body toning by stationarily pitting ones muscular strength against an immovable object fails to achieve maximum effect. Also, other body exercises performed during calisthenics do provide selective body movement and accompanying expansion and contraction of muscle tissue, but fail to acquire maximum efficiency in muscle development because such exercises do not incorporate the use of supplemental weights to concurrently force exertion of the muscle to its maximum endurance. The most effective form of body building exercises combine selective body movements directed towards one or more muscles while incorporating the use of extrinsic weights to force the muscle to function under pressure. For this reason, exercises performed while using the common weight lifting devices are most effective for achieving body development to its fullest and resulting physical fitness.

Various problems are readily manifested to those exercising with the common form of weight lifting devices that are presently available upon the market. To undertake a complete program of physical fitness with the use of a standard set of weights ordinarily requires the acquisition of hundreds of pounds of various weighted plates and other accessories at a high initial expense.

The use of the standard weight lifting device is generally accompanied by clangor-like noises which ordinarily prevent their usage in multiple dwellings, or anywhere else where none other than quietude is tolerated. It is also quite difficult to transport the foregoing type weight lifting set since it includes many loose component parts of excessive weight.

PRIOR ART

There have occasionally been developed various exercising and athletic training devices which incorporate the use of hydraulic means for regulation of apparatus that offers resistance against movement by any individual performing with said devices.

U.S. Pat. Nos. 3,451,271; 3,465,592 and 3,902,480 are directed to exercising and weight lifting devices. However, they are all directed to either hydraulic and electro-mechanical means for providing their function. Thus, a need exists for a simple yet highly versatile piece of equipment which may be used by many but at the same time quickly modified to meet the particular needs of the user.

SUMMARY OF THE INVENTION

In accordance with the invention claimed, an improved spring-controlled exercising device is provided which may be rapidly and easily adjusted to provide resistance against various forms of bodily movement such as is effected in regular exercises with weight lifting devices.

Another object of this invention is to provide a novel spring-controlled exercising device which may allow the user to simulate all forms of exercising functions as are presently accomplished through the use of the standard weight lifting set, but due to the cooperation of the spring means, dispenses with the need for any loosely mounted weights as are presently included in the aforesaid type weight lifting set.

A further object of this invention is to provide a compact exercising and weight lifting device which is integral in construction, void of any loosely connecting parts, and thereby may be utilized relatively silently to avoid disturbance to any proximate persons.

A still further object of this invention is to provide an exercising and weight lifting device incorporating calibrated adjusting means for use in accurately regulating the device's resistance against movement in opposite directions so that its user may exert a force such as when exercising and raising the device to stimulate a weight lifting action, and subsequently exert an opposite force for a return of the device.

A still further object of this invention is to provide a spring-controlled exercising and weight lifting device which provides for exercises encompassing multiple movements of one's body, the type of exercises that accomplish both the combined contraction and extension of one or more muscles while they are tightened under maximum stress as during usage of the spring-controlled and regulated load of said device.

A still further object of this invention is to provide an exercising and weight lifting device which is adaptable for use by anyone, whether weak or strong, and regardless of their inherent energy, since said device incorporates adjustment means for controlling the degree of force that must be exerted by the exerciser during its usage.

It is still an additional object of this invention to provide a spring-controlled exercising and weight lifting device which is compact in size and streamlined in appearance, has portability, adaptable for use in almost any locale, and due to its relatively few component parts is inexpensive to manufacture.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
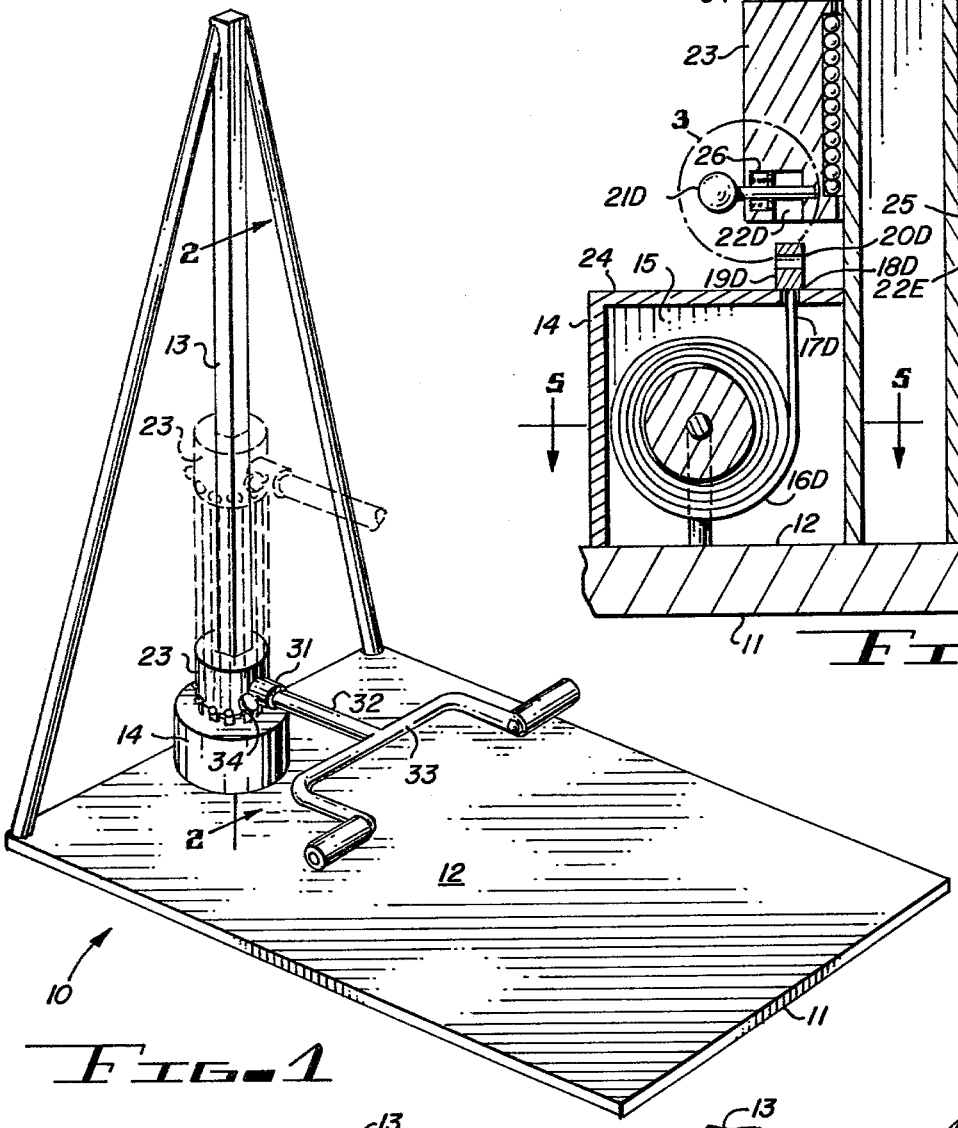
FIG. 1 is a perspective view of a new and improved exercising and weight lifting device embodying the invention.
Figure 2:
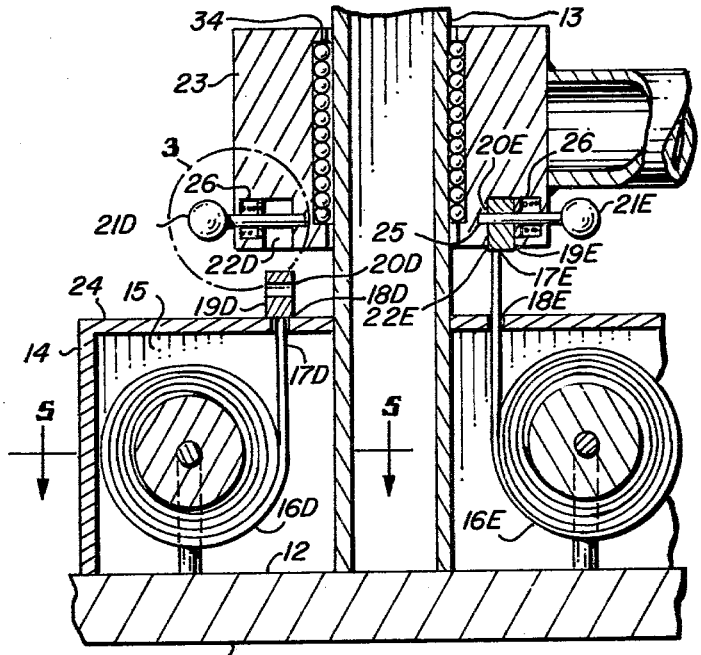
FIG. 2 is a cross-sectional view of FIG. 1 taken along the line 2—2.

Referring more particularly to the drawing by characters of reference, FIG. 1 discloses the improved exercising and weight lifting device 10 as shown in full assemblage ready to be used by an individual to simulate weight lifting exercises for the purpose of developing the muscles of the body. To assist in stablizing the individual during the exercise and to help him maintain his balance a platform 11 having a surface portion 12 is provided for horizontal positioning on a horizontal surface. As shown in FIGS. 1 and 2, the platform has suitably secured thereto at one end thereof a vertically positioned shaft 13 which may be of any suitable cross-sectional configuration, but is shown in the drawing as having a rectangular cross-sectional form.

A collar 14 surrounding shaft 13 is fastened to the top surface 12 of platform 11 or alternatively may be heavy enough to rest on and hold its surface engaging position when used. This collar comprises a hollow cylindrical configuration or opening 15 having spacedly positioned around the base of shaft 13 a plurality of constant force means such as constant force extension springs 16. Constant force extension springs are available in the marketplace and may be obtained from AMETEK, INC. under their tradename "Neg'ator".

The simplest constant force spring means is the extension spring which possesses high residual stresses forming a compact energy source. The spring is a prestressed strip of flat spring material which coils around a bushing or around successive layers of itself. When the spring is deflected by pulling its outer end, a resistance force P results. Force P has a line of action through Z, the center of its coil and does not increase with deflection. After passing through zone X, i.e., the periphery of its coil, the material flattens in the direction of the pull and the straightened material stores the converted energy. The force exerted by the constant force extension spring results from the tendency of the extended material to return to its present radius.

Extension springs may be mounted back to back, in tandem, or laminated to offer greater force in a minimum of space. When high torque is required and space is minimal, two or more springs can be backwound on the same output drum or spool to form a multiple motor means.

According to the invention disclosed, a plurality of these spring means such as a number of like or different spring means 16A–16E plus others of like or different constant spring forces are assembled within the hollow interior of collar 14 with their outer free ends 17A–17E, etc., as shown in FIG. 2, fed through openings 18A–18F, etc. in collar 14 and are then attached to block 19A–19E, etc.

These blocks are each provided with an aperture extending therethrough, such as apertures 20A–20D, etc., which are arranged for receiving associated pins 21A–21E, etc.

These pins are spring biased to move into and out of associated openings 22A–22E, etc. in a collar 23 slidably mounted around and movable along the length of shaft 13, as shown in FIG. 1.

Since the blocks 19 are larger than openings 18 in collar 14, the ends of all of the coil springs 16 will be held at or above the top surface 24 of collar 14, as shown in FIG. 2. Further, the position of blocks 19 are such that they align up with openings 22 in the bottom surface of collar 23 so that the bottom surface 25 of collar 23 may set on top of the top surface 24 of collar 14 with blocks 19 positioned in the associated openings 22 in collar 23 providing all of the pins 21 are pulled back against their spring biasing means 26 and locked in their outwardly extended positions.

Figure 3:
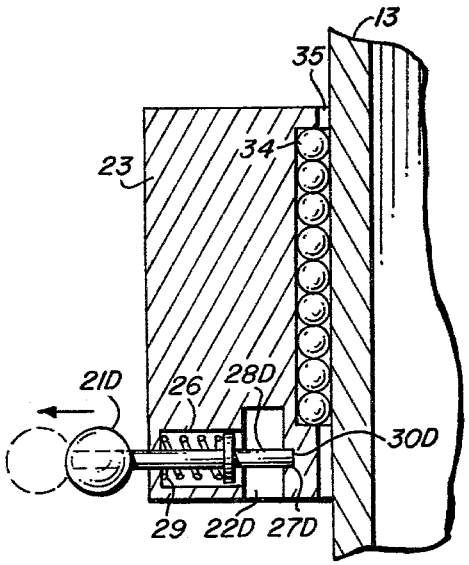
FIG. 3 is an enlarged portion of the apparatus shown in the circled part of FIG. 2 identified by the reference character 3.

This locking means, as shown in FIG. 3, comprises a pin 21D which is spring biased to force its end 27D into and through opening 22D in collar 23. The end 27D has a key 28D which fits into a keyway formed in the apertured side walls of opening 22D. Thus, if pin 21D is drawn to the left, as shown by the arrow, it will draw the end 27D out of the keyway and into the opening 29 in collar 23 and if the pin is rotated slightly, the pin end 27D may be held out of opening 22D. Accordingly, all of the various pins 21, one for each coil spring 16, may be held out of openings 22 all around collar 14 so that collar 23 may sit on top of the surface 24 of collar 14 with all of the block ends 19 in the associated openings 22.

When a user decides to exercise, he or she may interlock any particular spring or combination of them with collar 23 by releasing selected pins causing their ends 27 to penetrate the apertures in blocks 19 and interlock with associated apertures in collars 23.

As noted from FIG. 1, collar 23 is provided with a hollow sleeve 31 into which extends a shaft 32 of a handlebar style gripping bar 33. The shaft is held in sleeve 31 by a hand tightening bolt 34 threadedly mounted to extend through the surface of sleeve 31 into engagement with shaft 32 in a well known manner.

Thus, as the gripping bar is raised and lowered, a variety of exercises may be performed simulating weight lifting motions that require an exertion of muscle straining forces. These forces are preselected by the user by connecting any one or a combination of the constant force or torque springs mounted in collar 14 to collar 23.

As noted from FIGS. 2 and 3 of the drawing, collar 23 comprises a linear bearing employing a plurality of ball bearings 34 mounted around and maintained in the opening 35 in collar 23 which is sized to receive shaft 13 of the weight lifting device 10. This form of structure keeps the collar from binding on the shaft regardless of the position of the selected springs 16 used in the weight lifting operation.

Figure 4:
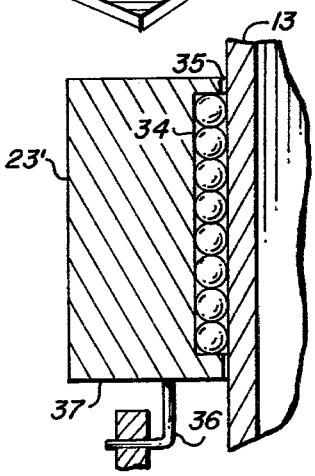
FIG. 4 illustrates a modification of the means of attaching the sliding bearing collar showing in FIG. 1 to the constant force springs attached to the base of the apparatus.
Figure 5:
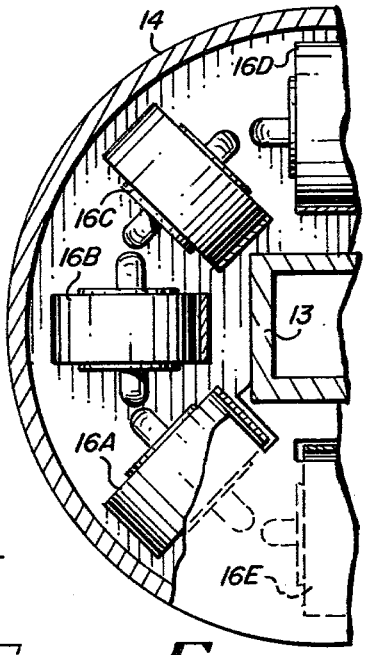
FIG. 5 is a cross-sectional view of FIG. 3 taken along the line 5—5.

FIG. 4 illustrates another means of attaching collar 23' to the various springs 16 wherein an integral right angle arm member 36 extending from the base surface 37 of collar 23 is inserted through the opening 20 in the blocks 19 at the ends of springs 16 to permanently engage given constant torque springs 16.

Figure 6:
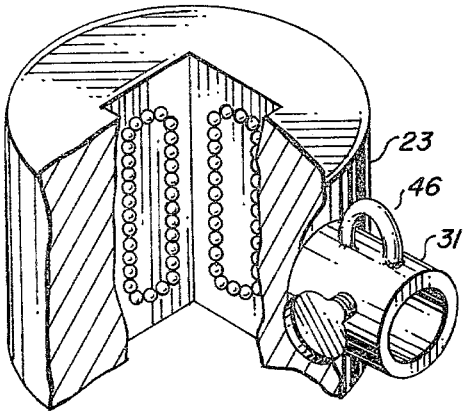
FIG. 6 is a perspective view partially broken away of the sliding bearing collar shown in FIG. 1.
Figure 7:
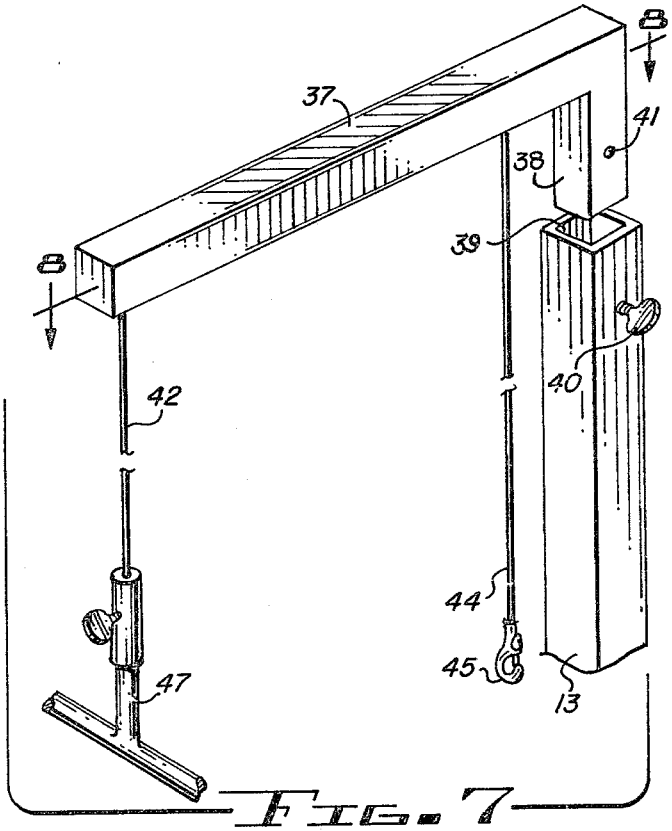
FIG. 7 is a perspective view of a modification of the apparatus shown in FIG. 1.
Figure 8:
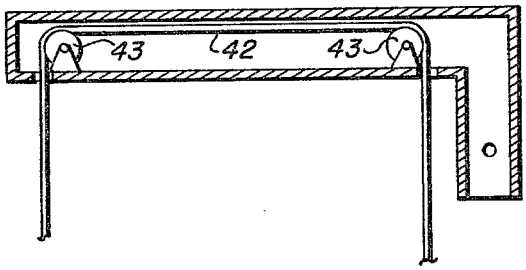
FIG. 8 is a cross-sectional view of FIG. 7 taken along the line 8—8.

FIGS. 6, 7 and 8 of the drawing illustrate the versatility of the exercising apparatus in that an extention L-shape bar 37 may have its leg 38 inserted in the hollow upper opening 39 of shaft 13 and held therein by cooperating hand bolt 40 threaded or fitted into an opening 41 in leg 38.

This L-shaped bar 37 may be fitted with a pull rope 42 which is threaded through bar 37 over pulleys 43 having one end 44 provided with a clamp 45 for engaging a suitable catch on sleeve 23 such as, for example, catch 46 on sleeve 31 as shown in FIG. 6.

The other end of rope 42 is clamped to a gripping bar 47 so that device 10 may be converted to a pulling exercising apparatus rather than a lifting apparatus as shown in FIG. 1.

Figure 9:
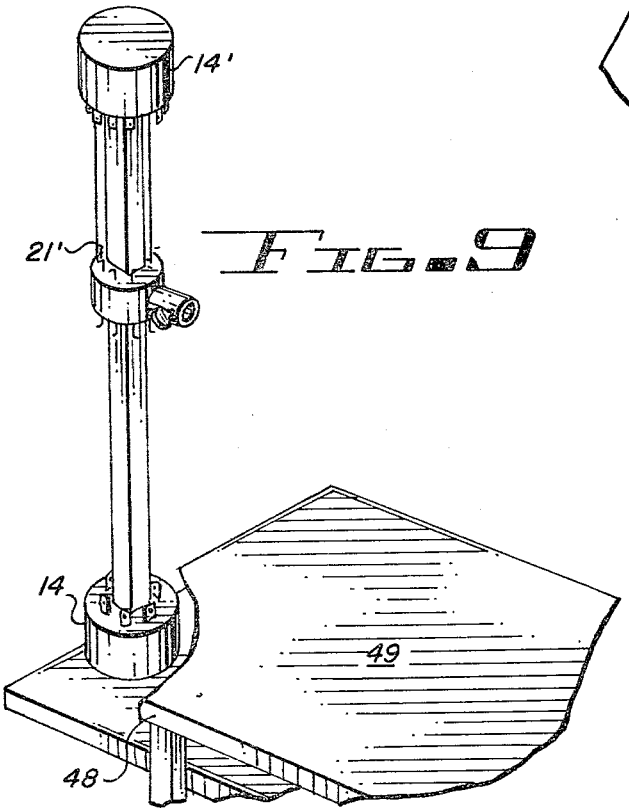
FIG. 9 is a perspective view of a further modification of the apparatus shown in FIG. 1 modified to employ the constant force spring means at either or both ends of the vertical post.

FIG. 9 shows a further modification of the device shown in FIG. 1 wherein the top of shaft 13 may be provided with a collar 14' comprising an inverted collar 14 which is arranged to engage with suitable pin attachment means 21' of the type described for use of the device shown in FIGS. 1–3. In this instance, a bench 48 may be positioned over the platform 11 so that weight pulling exercises may be performed while the user is lying flat on his back on the bench top 49.

Figure 11:
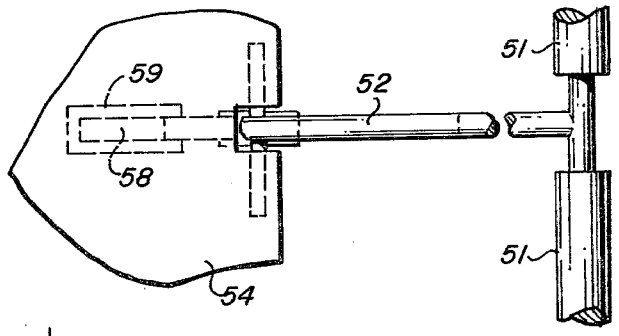
FIG. 11 is a cross-sectional view of FIG. 10 taken along the line 11—11.
Figure 10:
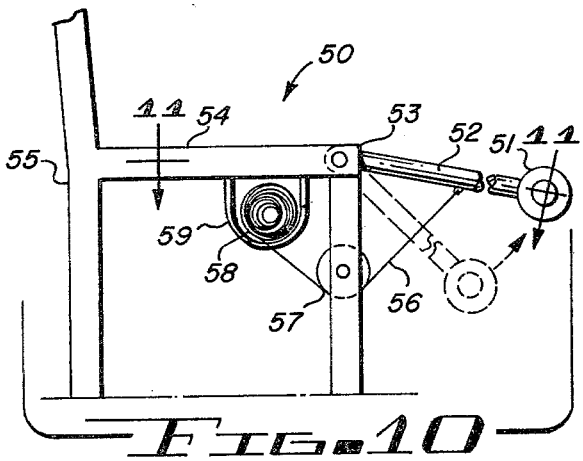
FIG. 10 is a still further modification of the apparatus shown in FIGS. 1 and 9 wherein the constant force spring means may be used on a chair for a foot and leg exercising function.

FIGS. 10 and 11 disclose a leg exercising apparatus 50 with which the legs of the user may be exercised by gripping the under surface of the foot gripping bars 51 by the feet of the user. Bars 51 form the T member of a shaft 52 which is pivotally mounted in the front edge 53 of the seat 54 of a chair 55.

As noted, the shaft 52 is connected by a suitable rope or wire 56 connected around a roller 57 to a constant torque spring 58 mounted in a housing 59 attached to the bottom of the seat 54 of the chair. The springs 16 and 58 may be any type of constant torque and forced coil spring and can comprise a constant torque band, as shown in FIGS. 1 and 2, or a wire spring, as shown in FIGS. 10 and 11.

Although but a few embodiments of the invention have been illustrated and described, it will be apparent to those skilled in the art that various changes and modifications may be made therein without departing from the spirit of the invention or from the scope of the appended claims.

What is claimed is:

1. A multi-functional exercising device comprising:

a shaft substantially vertically mounted on a horizontal surface, a first hollow collar immovably fixedly positioned at one end of said shaft, a plurality of springs mounted within the hollow configuration of said collar and attached to said first collar and each of said springs having a free end extending therefrom, a second collar slidably mounted on said shaft, said second collar having a gripping means extending laterally therefrom, and means mounted on said second collar for selectively grasping the free ends of said springs, whereby when said first and second collars are attached by means of said springs, said springs will provide a load force on said gripping means when a lifting force is applied to raise said second collar on the shaft relative to said first collar.

2. The multi-functional exercising and weight lifting device set forth in claim 1 wherein:

said springs comprises constant force extension springs.

3. The multi-functional exercising and weight lifting device set forth in claim 1 wherein:

each said spring being a constant force spring attached to said first collar and each said spring having a free end extending therefrom, and each said spring being detachably connected to said second collar, said second collar comprising gripping means for selectively grasping the free ends of said springs.

4. The multi-functional exercising device set forth in claim 1 wherein:

said springs are constant force narrow metallic band members and each said spring arranged in a coiled configuration.

5. The multi-functional exercising and weight lifting device set forth in claim 1 wherein:

said springs being positioned around said one end of said shaft.

6. The multi-functional exercising device set forth in claim 1 wherein:

the free ends of said springs extending through openings in said first collar and are held there by blocks mounted on the free ends of said springs, and said gripping means comprises pin means mounted on said second collar for selectively gripping said blocks of said spring means.

7. The multi-functional exercising and weight lifting device set forth in claim 1 wherein:

said second collar is provided with bearing means within said second collar for engaging said shaft for reducing sliding friction of said second collar in its movement along said shaft and preventing binding of said second collar with said shaft.

* * * * *